US006867403B2

(12) United States Patent
Shon et al.

(10) Patent No.: US 6,867,403 B2
(45) Date of Patent: Mar. 15, 2005

(54) APPARATUS AND METHOD FOR AUTOMATIC COOKING

(75) Inventors: Jong-Chull Shon, Suwon (KR); Boris V. Rayskiy, Suwon (KR); Tai Eun Kim, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 47 days.

(21) Appl. No.: 10/397,386

(22) Filed: Mar. 27, 2003

(65) Prior Publication Data

US 2004/0104224 A1 Jun. 3, 2004

(30) Foreign Application Priority Data

Dec. 2, 2002 (KR) ..... 10-2002-0075784

(51) Int. Cl.[7] ..... H05B 6/50

(52) U.S. Cl. ..... 219/707; 219/400; 219/731

(58) Field of Search ..... 219/385, 399, 219/400, 472, 492, 494, 506, 570, 678, 681, 682, 686, 687, 688, 702, 707, 710, 725, 731; 99/330, 331, 403, 325, 326, 332; 426/233, 237, 243, 438, 510

(56) References Cited

U.S. PATENT DOCUMENTS 4,233,327 A * 11/1980 Ando et al. ..... 426/242
4,401,884 A * 8/1983 Kusunoki et al. ..... 219/492
4,499,357 A * 2/1985 Kojima ..... 219/711
4,571,341 A * 2/1986 Sugimura ..... 426/510
5,567,458 A * 10/1996 Wu ..... 426/233
5,589,094 A * 12/1996 Bu ..... 219/711
6,472,650 B1 * 10/2002 Kim et al. ..... 219/716
2004/0103794 A1 * 6/2004 Shon et al. ..... 99/330

FOREIGN PATENT DOCUMENTS

CN 1060591 4/1992
JP 2104248 4/1990

* cited by examiner

*Primary Examiner*—Tu Hoang
(74) *Attorney, Agent, or Firm*—Staas & Halsey LLP

(57) ABSTRACT

An apparatus and a method automatically cook food, for example, millet, thus conveniently providing the uniform and optimal cooking quality of food to a user. The cooking apparatus includes a cooking cavity that contains food to be cooked and water therein, and a heating unit that heats the food and the water. The cooking apparatus further includes a control unit operated to heat the food and the water at a preset initial output of the heating unit, to reduce the output of the heating unit to a first reduced output and cook a surface of the food by allowing a heated high temperature water to be absorbed into the food after the water has boiled, and to reduce the output of the heating unit to a second reduced output and cook an inside of the food using the high temperature water absorbed into the food.

41 Claims, 5 Drawing Sheets

FIG. 3

| QUANTITY | BLOWING TIME | BOILING | | | SIMMERING | | STEAMING STAGE | |
|---|---|---|---|---|---|---|---|---|
| | | OUTPUT ($P_f$) | COEFFICIENT ($\rho$) | MAXIMUM $T_f$ | OUTPUT ($P_1$) | TIME ($T_1$) | OUTPUT ($P_e$) | END TIME ($T_e$) |
| QUANTITY FOR ONE PERSON | 0:50 | 800W | 0.60 | 5:00 | 400W | 3:00 | 200W | 16:00 |
| QUANTITY FOR TWO PERSON | | | | 6:00 | | 4:00 | | 21:00 |
| QUANTITY FOR THREE PERSON | | | | 7:00 | 500W | 5:00 | | 24:00 |
| QUANTITY FOR FOUR PERSON | | | | 8:00 | | | | |

APPARATUS AND METHOD FOR AUTOMATIC COOKING

CROSS-REFERENCE TO RELATED APPLICATIONS

This application claims the benefit of Korean Application No. 2002-75784, filed Dec. 2, 2002, in the Korean Intellectual Property Office, the disclosure of which is incorporated herein by reference.

BACKGROUND OF THE INVENTION

1. Field of the Invention

The present invention relates, in general, to an apparatus and a method for automatic cooking, and, more particularly, to an apparatus and a method for automatic cooking, which cook food using an automatic cooking algorithm.

2. Description of the Related Art

A basic method of cooking millet, which is a type of hulled grain, is to put millet and a proper amount of water in a vessel, and steam the millet by heating the vessel. If heat is directly applied to the vessel that contains the millet and the water, the heat is transmitted through the vessel, so the water contained in the vessel is boiled. While the water is boiling, the millet is cooked to become edible. However, if the millet is heated at an extremely high temperature for a long time during cooking, the surfaces of millet grains may be damaged. Accordingly, the cooking of the millet should be carried out while heating power is reduced in stages to obtain the satisfactory cooking result of the millet. Additionally, the cooking result depends on respective durations of the cooking stages.

When millet is cooked, a gas/electric equipment, such as a cooking top, is generally used to heat a vessel containing the millet. Notwithstanding that the cooking quality of the millet depends on the precise control of an applied heating power and a cooking time for which the millet is cooked, the cooking of the millet is carried out depending on the judgment of a cook, so it is difficult to obtain an optimal and uniform cooking quality of the millet. Additionally, a cook should control the heating power and ascertain the cooking state of the millet while maintaining vigilance over cooking equipment, so the cook may not do other things until cooking is terminated. That is, the cook may not effectively manage the cooking time of the millet.

SUMMARY OF THE INVENTION

Accordingly, it is an aspect of the present invention to provide an apparatus and a method for automatic cooking, which automatically cook millet, thus conveniently providing the uniform and optimal cooking quality of millet to a user.

Additional aspects and/or advantages of the invention will be set forth in part in the description which follows and, in part, will be obvious from the description, or may be learned by practice of the invention.

The foregoing and/or other aspects of the present invention are achieved by providing an apparatus for automatic cooking including a cooking cavity that contains food to be cooked and water therein, a heating unit that heats the food and the water, and a control unit operated to heat the food and the water at a preset initial output of the heating unit, first to reduce the output of the heating unit to a first reduced output and cook a surface of the food by allowing a heated high temperature water to be absorbed into the food after the water has boiled, and second, to reduce the output of the heating unit to a second reduced output and cook an inside of the food using the high temperature water absorbed into the food.

Additionally, the foregoing and/or other aspects of the present invention are achieved by providing an apparatus for automatic cooking including a cooking cavity that contains food to be cooked and water therein, a heating unit that heats the food and the water, a gas sensor that detects properties of air inside the cooking cavity, and a control unit operated to obtain an output of the gas sensor while the food and the water are heated at a preset initial output of the heating unit, first to reduce the output of the heating unit to a first reduced output and cook a surface of the food by allowing a heated high temperature water to be absorbed into the food if the output of the gas sensor reaches a preset value, and second, to reduce the output of the heating unit to a second reduced output and cook an inside of the food using the high temperature water absorbed into the food.

The foregoing and/or other aspects of the present invention are achieved by providing a method of automatic cooking using a cooking apparatus, the cooking apparatus having a cooking cavity that contains food to be cooked and water therein, and a heating unit that heats the food and the water, including heating the food and the water at a preset initial output of the heating unit, first reducing an output of the heating unit to a first reduced output and cooking a surface of the food by allowing a heated high temperature water to be absorbed into the food after the water has boiled, and second, reducing the output of the heating unit to a second reduced output and cooking an inside of the food using the high temperature water absorbed into the food.

Additionally, the foregoing and/or other aspects of the present invention are achieved by providing a method of automatic cooking using a cooking apparatus, the cooking apparatus having a cooking cavity that contains food to be cooked and water therein, a heating unit that heats the food and the water, and a gas sensor that detects properties of air inside the cooking cavity, including obtaining an output of the gas sensor while the food and the water are heated at a preset initial output of the heating unit, first, reducing the output of the heating unit to a first reduced output and cooking a surface of the food by allowing a heated high temperature water to be absorbed into the food if the output of the gas sensor reaches a preset value, and second, reducing the output of the heating unit to a second reduced output and cooking an inside of the food using the high temperature water absorbed into the food.

BRIEF DESCRIPTION OF THE DRAWINGS

These and/or other aspects and advantages of the invention will become apparent and more readily appreciated from the following description of the preferred embodiment, taken in conjunction with the accompanying drawings of which:

FIG. 3 is a table illustrating the cooking characteristics of millet using the microwave shown in FIG. 1;

DETAILED DESCRIPTION OF THE PREFERRED EMBODIMENTS

Figure 1:
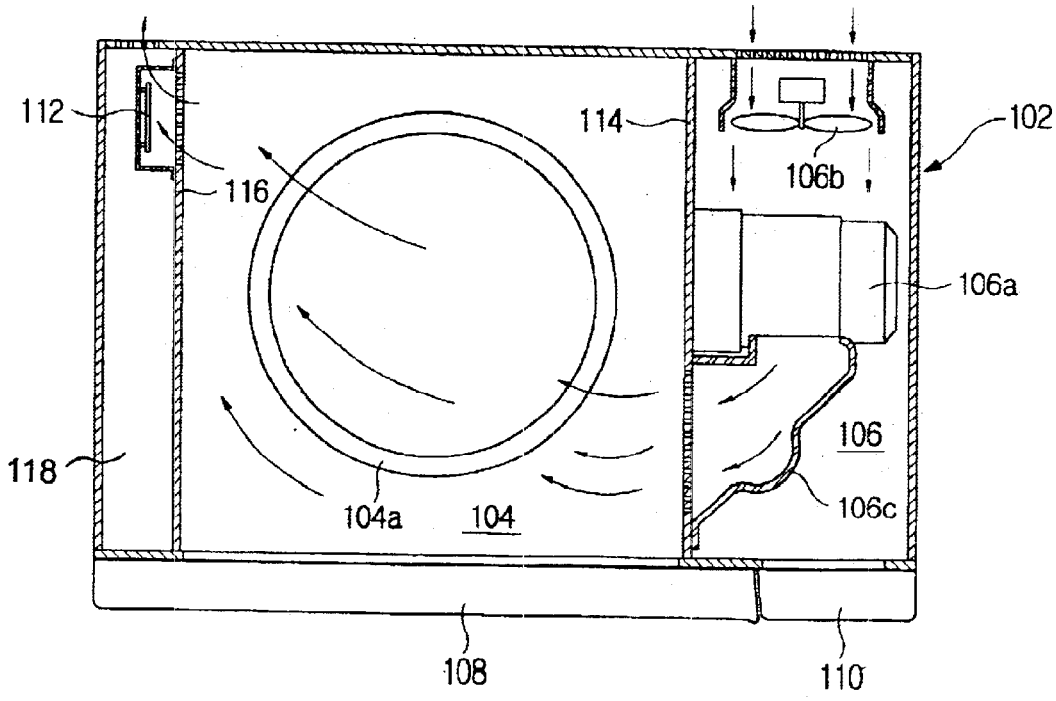
FIG. 1 is a sectional view of a microwave oven in accordance with an embodiment of the present invention.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

An apparatus and a method are used for automatic cooking in accordance with an embodiment of the present invention, with reference to FIGS. 1 to 5. FIG. 1 is a sectional view of a microwave oven in accordance with an embodiment of the present invention. As shown in FIG. 1, a body 102 of the microwave oven is divided into a cooking cavity 104 and a machine room 106 separated from each other by a partition wall 114. A control panel 110 and a door 108 are positioned in front of the body 102.

A cooking tray 104*a* is disposed to be rotatable in a lower part of the cooking cavity 104, and food to be cooked is put on the cooking tray 104*a*. A space 118 separated from the cooking cavity 104 by a partition wall 116 is positioned to be opposite to the machine room 106. In the space 118, a gas sensor 112 is disposed to detect specific properties of air inside the cooking cavity 104. The gas sensor 112 is used to detect an amount of moisture contained in the air inside the cooking cavity 104 and output a voltage signal S that is inversely proportional to the amount of the moisture contained in the air.

The machine room 106 includes a magnetron 106*a*, a cooling fan 106*b* and an air duct 106*c*. The magnetron 106*a* generates microwaves. The cooling fan 106*b* cools the magnetron 106*a* by sucking external air. The air sucked through the cooling fan 106*b* is supplied to the cooking cavity 104 through the air duct 106*c* of the machine room 106. The air passed through the cooking cavity 104 is discharged from the body 102 while passing the gas sensor 112.

Figure 2:
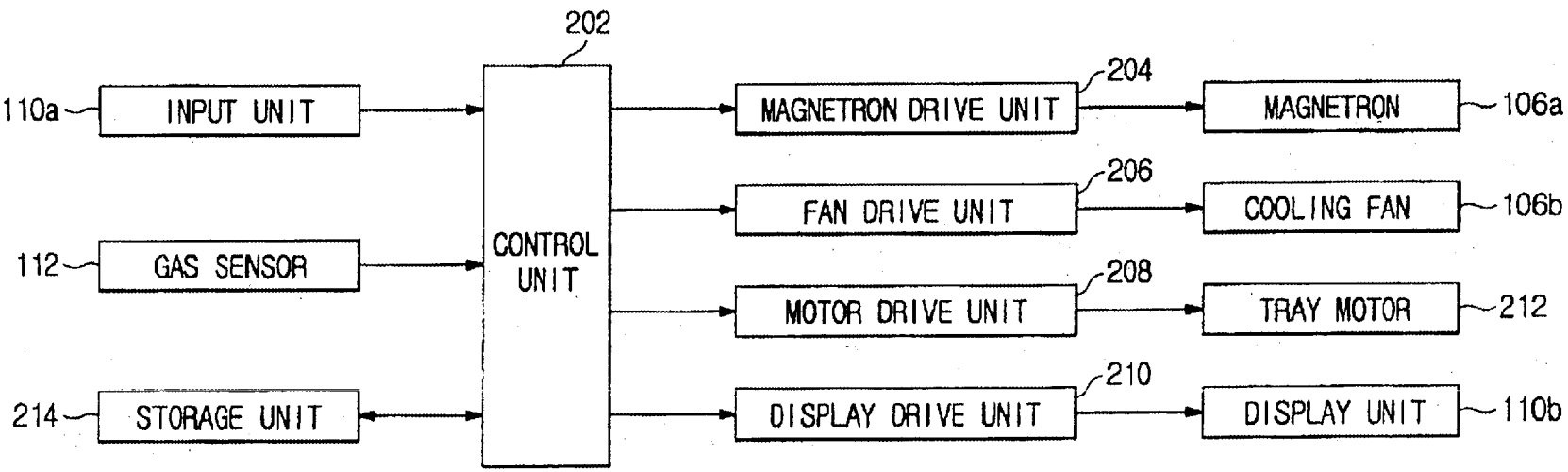
FIG. 2 is a control block diagram of the microwave oven shown in FIG. 1.

FIG. 2 is a control block diagram of the microwave oven shown in FIG. 1. As shown in FIG. 2, a control unit 202 is connected at its input terminals to an input unit 110*a*, the gas sensor 112, and a storage unit 214. The input unit 110*a* is positioned in the control panel 110 shown in FIG. 1. A user selects or inputs cooking conditions, sets values, etc., through the input unit 110*a*. The storage unit 214 stores programs, cooking data, etc., that are required to control the overall operation of the microwave oven. For example, the cooking data include data on the respective outputs of the magnetron 106*a* and respective cooking times of cooking stages that are required to cook millet. The control unit 202 allows the millet to be cooked automatically by determining the outputs of the magnetron 106*a* and the cooking times with reference to the cooking data stored in the storage unit 214.

The control unit 202 is connected at output terminals to a magnetron drive unit 204, a fan drive unit 206, a motor drive unit 208 and a display drive unit 210 that drive the magnetron 106*a*, the cooling fan 106*b*, a tray motor 212 and a display unit 110*b*, respectively. The tray motor 212 rotates the tray 104*a* disposed in the cooking cavity 104. The display unit 110*b* is positioned on the control panel 110 shown in FIG. 1, and displays cooking conditions, set values, cooking progressing state, etc. that are inputted from a user.

In order to implement the apparatus and the method for automatic cooking using the present invention, it is desirable to obtain the cooking data of the millet required to obtain an optimal and uniform cooking quality of the millet by ascertaining the properties of the millet and executing cooking tests under various conditions. If the millet is heated at a high temperature for a short time, the insides of millet grains are not sufficiently cooked and the surfaces of the millet grains are damaged. Accordingly, water should be heated enough to be boiled at the start of the cooking of the millet. Then, when the water is boiled, the millet should be cooked for a sufficient time so that the heated water is absorbed into the millet grains while heating power is being reduced. To obtain the optimal cooking quality of the millet, appropriate heating power and cooking time, as described below, should be controlled in each of the cooking stages.

The cooking stages of the millet are divided into a boiling stage, a simmering stage, a steaming stage for thoroughly cooking boiled millet, and appropriate heating power and cooking times are set in each of the cooking stages. To cook the millet, the boiling stage in which water is boiled, is carried out by heating a vessel that contains the water and the millet. After the water is boiled, the simmering stage, in which the heating power is reduced to prevent the boiled water from overflowing outside the vessel while the reduced heating power is maintained for a predetermined time to sufficiently simmer the water, is carried out so that high temperature water is sufficiently absorbed into the insides of the millet grains. When the simmering stage is completed, the steaming stage is carried out, in which the heating power is further reduced and the millet is cooked for a sufficient time so that the insides of the millet grains are completely cooked by the high temperature water absorbed into the insides of the millet grains. That is, the surfaces of the millet grains are heated and cooked in the simmering stage, and the insides of the millet grains are heated and cooked in the steaming stage.

Cooking characteristics of the millet described above are shown in FIGS. 3 and 4. FIG. 3 is a table of the cooking characteristics of the millet, which illustrates the outputs of the magnetron 106*a* and cooking times needed in the cooking stages according to the predetermined quantity of the millet to be cooked. To carry out automatic cooking of the millet according to the present invention, an initial stage in which an initial output $S_0$ of the gas sensor 112 is calculated is performed before the magnetron 106*a* is operated. That is, the cooking time of the boiling stage depends on an amount of moisture generated in the boiling stage in the automatic cooking of the millet according to the present invention. An end time point of the boiling stage is determined on the basis of the ratio of the current output S of the gas sensor 112 to the initial output $S_0$ of the gas sensor 112. In the initial stage, to obtain the initial output $S_0$ of the gas sensor 112, moisture inside the cooking cavity 104 is minimized by blowing external air into the cooking cavity 104 for a predetermined time, for example, 50 seconds, and circulating the air using the cooling fan 106*b* of the machine room 106. When the blowing of the air is completed, the initial output $S_0$ of the gas sensor 112 is obtained.

In the boiling stage, the output Pf of the magnetron 106*a* is 800 W. The cooking time of the boiling stage ranges from an initial time point to a time point at which the ratio of the current output S of the gas sensor 112 to the initial output $S_0$ of the gas sensor 112 is greater than a preset coefficient ρ, that is, $S/S_0>\rho$. The coefficient ρ is 0.6 when the automatic cooking of the millet is carried out. That is, if the current output S of the gas sensor 112 is equal to or less than 60% of the initial output $S_0$ of the gas sensor 112, the boiling stage is terminated. Further, if the current output S of the gas sensor 112 is reduced to be equal to or less than a preset value $\phi$, the boiling stage may be set to be terminated. The preset value $\phi$ may be changed according to the characteristics and type of the gas sensor 112, and is set to a value by which the cooking time of the boiling stage may be limited to an optimal time obtained by cooking tests regardless of what kind of the gas sensor is being used. However, when equipment malfunctions, such as the wrong operation of the gas sensor 112 occurs, the cooking time $T_f$ of the boiling stage is limited to a maximum of 5 to 8 minutes in order to prevent the cooking time from being overextended.

When the boiling stage is completed, after the output of the magnetron 106*a* is reduced to 50~60% of its initial output, the millet is cooked for 3~5 minutes according to the predetermined quantity of the millet to carry out the simmering stage. For example, the simmering stage is carried out at the output of 400 W for 3 or 4 minutes if the predetermined quantity of the millet corresponds to the quantity for one or two persons, respectively. In contrast, the simmering stage is carried out at the output of 500 W for 5 minutes if the predetermined quantity of the millet corresponds to the quantity for three or four persons.

In the steaming stage, the output of the magnetron 106*a* is reduced to 45~55% of the output of the simmering stage, that is, 22.5~33% of the output of the boiling stage, regardless of the quantity of the millet to be cooked. The millet is heated until a total cooking time reaches 16 to 24 minutes, depending on the quantity of the millet. In the steaming stage, the insides of the millet grains are completely cooked. However, since a heat transfer rate is gradually decreased in the insides of the millet grains, the insides of the millet grains are allowed to be sufficiently cooked by reducing the output of the magnetron 106*a* of the steaming stage and increasing the cooking time of the steaming stage in order to prevent the surfaces of the millet grains from being damaged. As shown in FIG. 3, the total cooking time according to the quantity of the millet is set to 16 minutes, 21 minutes and 24 minutes when the quantity of the millet corresponds to the quantity for one person, two persons, and three or four persons, respectively. Accordingly, it will be appreciated that the steaming stage of the automatic cooking of the millet is carried out for the remaining time obtained by subtracting the cooking time of the boiling and simmering stages from the total cooking time. Alternatively, the cooking time of the steaming stage may be set to a preset time as the simmering stage is carried out for a preset cooking time.

Figure 4:
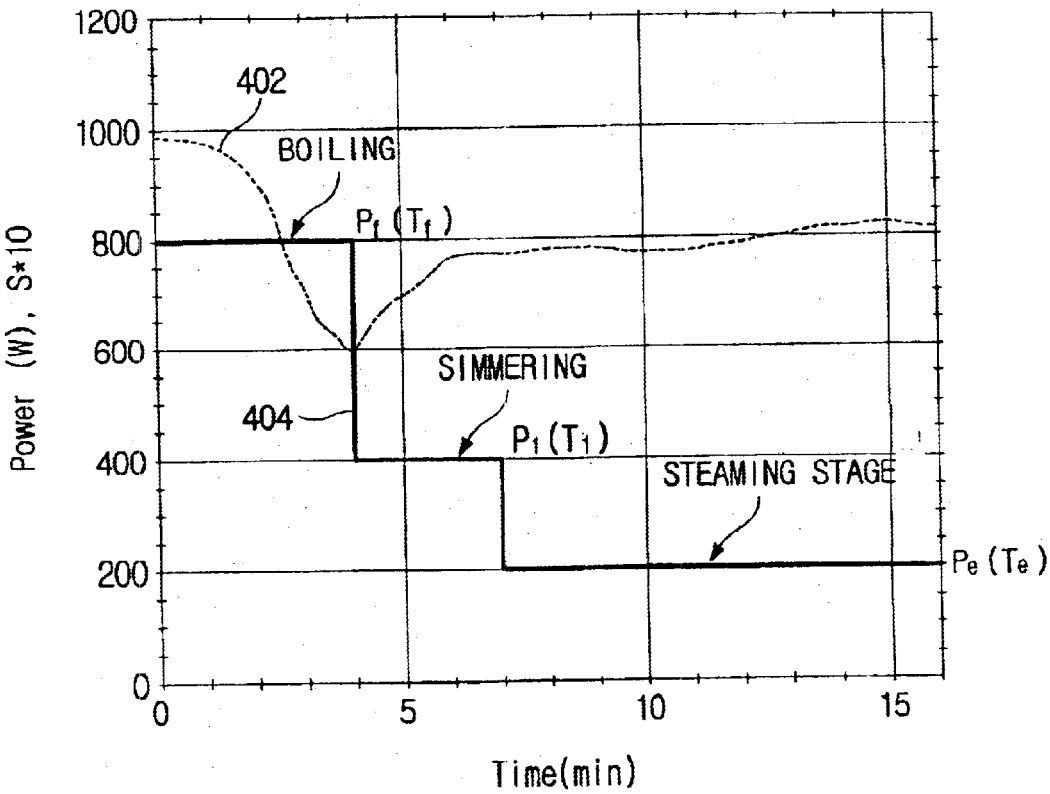
FIG. 4 is a graph illustrating an example of a cooking algorithm regarding cooking millet in the microwave oven shown in FIG. 1.

FIG. 4 is a graph of a cooking algorithm of the millet of the microwave oven in accordance with the embodiment of the present invention, which illustrates a case where millet for one person is cooked. A characteristic curve 402 represents the output of the gas sensor 112, that is, the voltage of the gas sensor 112, and the characteristic curve 404 represents the output P of the magnetron 106*a* and the cooking time T of the millet. In FIG. 4, after an initial stage of blowing external air into the cooking cavity for a period of 50 seconds, the boiling stage to cook the millet for one person is carried out at an output of 800 W for about 4 minutes. At the time point 4 minutes after the start of cooking of the millet, that is, the starting point of the simmering stage, the current output S is reduced to 60% of the initial output $S_0$. After the boiling stage is completed, the simmering stage is carried out at the output of 400 W for 3 minutes. Subsequently, the steaming stage is carried out at the output of 200 W until the total cooking time reaches 16 minutes. That is, in the case of the millet cooking shown in FIG. 4, since the initial stage, the boiling stage and the simmering stage are each carried out for 50 seconds, 4 minutes and 3 minutes, respectively, the steaming stage is carried out for 8 minutes and 10 seconds. Thus, the total cooking time is 16 minutes.

Figure 5:
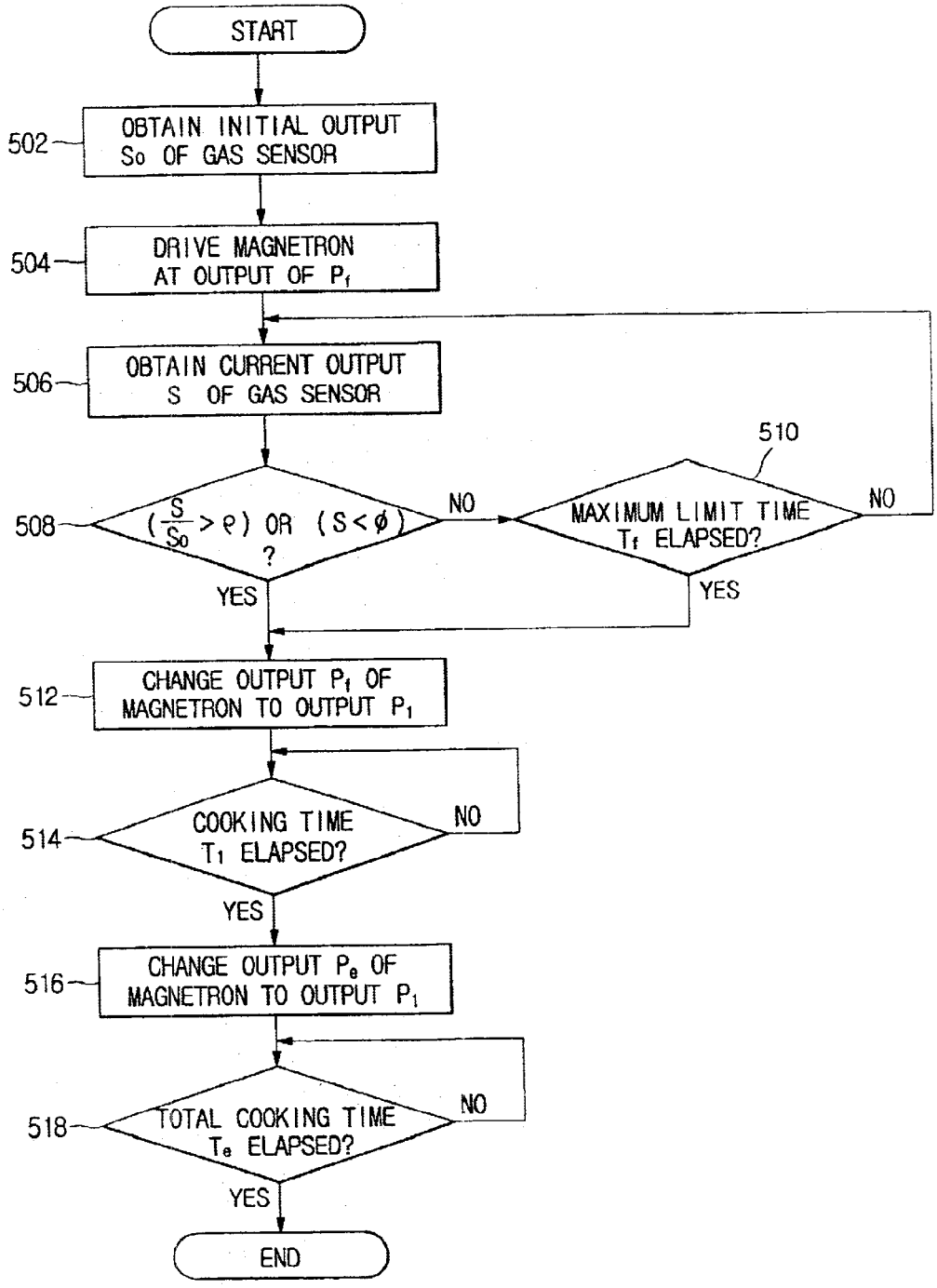
FIG. 5 is a flowchart of a method of cooking millet using the microwave oven shown in FIG. 1.

FIG. 5 is a flowchart of a method of cooking millet using the microwave oven shown in FIG. 1. As shown in FIG. 5, after moisture inside the cooking cavity 104 is minimized by blowing air into the cooking cavity 104 of the microwave oven, the initial output $S_0$ of the gas sensor 112 is obtained in operation 502. Then, the boiling stage is carried out at the output $P_f$ of the magnetron 106*a* in operation 504. The current output S of the gas sensor 112 is obtained for the boiling stage in operation 506. It is determined whether $S/S_0$ is greater than $\rho$ or S is less than $\phi$, that is, $S/S_0>\rho$ or $S<\phi$ in operation 508. If $S/S_0>\rho$ or $S<\phi$, the simmering stage is carried out at an output $P_1$ after the output of the magnetron is changed to the output $P_1$ in operation 512. To the contrary, if $S/S_0 \leqq \rho$ or $S \geqq \phi$, it is determined whether the maximum limit time of the $T_f$ of the boiling stage has elapsed in operation 510. If the maximum limit time of the $T_f$ has not elapsed, the operation 506 of obtaining the current output S of the gas sensor 112 is repeated; while if the maximum limit time of the $T_f$ has elapsed, the simmering stage is carried out at the output $P_1$ after the output of the magnetron 106*a* is changed to the output $P_1$ in operation 512. Then, it is determined whether a preset cooking time $T_1$ of the simmering stage has elapsed in operation 514. If the preset cooking time $T_1$ of the simmering stage has elapsed, the steaming stage is carried out at an output $P_e$ after the output of the magnetron 106*a* is changed to the output $P_e$ in operation 516. Then, it is determined whether a preset total cooking time $T_e$ has elapsed in operation 518. If the preset total cooking time $T_e$ has elapsed, the cooking of the millet is terminated.

As is apparent from the above description, the present invention provides an apparatus and a method for automatic cooking, which cook millet according to an automatic cooking algorithm, thus providing the uniform and optimal cooking quality of the millet in every cooking of millet.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An apparatus for automatic cooking, comprising:

a cooking cavity that contains food to be cooked and water therein;

a heating unit that heats the food and the water; and a control unit operated to heat the food and the water at a preset initial output of the heating unit, to reduce the output of the heating unit to a first reduced output and cook a surface of the food by allowing a heated temperature water to be absorbed into the food after the water has boiled, and to reduce the output of the heating unit to a second reduced output and cook an inside of the food using the heated temperature water absorbed into the food.

2. The apparatus as set forth in claim 1, wherein the food includes millet.

3. The apparatus as set forth in claim 1, wherein the first reduced output of the heating unit is 50~60% of the initial output, and the second reduced output of the heating unit is 45~55% of the first reduced output.

4. The apparatus as set forth in claim 1, wherein the heating unit is a high frequency generation unit, an initial output of the high frequency generation unit is 800 W, the first reduced output of the high frequency generation unit is from 400~500 W and the second reduced output of the high frequency generation unit is 200 W.

5. The apparatus as set forth in claim 4, wherein the first reduced output is 400 W if the food corresponds to a quantity for one or two persons, and the second reduced output is 500 W if the food corresponds to a quantity for three or four persons.

6. An apparatus for automatic cooking, comprising:

a cooking cavity that contains food to be cooked and water therein;

a heating unit that heats the food and the water;

a gas sensor that detects properties of air inside the cooking cavity; and a control unit to obtain an output of the gas sensor while the food and the water are heated at a preset initial output of the heating unit, to reduce the output of the heating unit to a first reduced output and cook a surface of the food by allowing a heated temperature water to be absorbed into the food if the output of the gas sensor reaches a preset value, and to reduce the output of the heating unit to a second reduced output and cook an inside of the food using the heated temperature water absorbed into the food.

7. The apparatus as set forth in claim 6, wherein the control unit obtains an initial output of the gas sensor before the food and the water are heated and current output of the gas sensor when the food and the water are heated, and reduces the output of the heating unit to the first reduced output if a ratio of the current output of the gas senor to the initial output of the gas sensor reaches a preset value.

8. The apparatus as set forth in claim 7, wherein the control unit reduces the output of the heating unit to the first reduced output if the current output of the gas sensor is equal to or less than 60% of the initial output of the gas sensor.

9. The apparatus as set forth in claim 6, wherein the food includes millet.

10. The apparatus as set forth in claim 6, wherein moisture inside the cooking cavity is minimized by circulating the air inside the cooking cavity to obtain the initial output of the gas sensor.

11. The apparatus as set forth in claim 10, further comprising a blowing unit that circulates the air inside the cooking cavity, wherein the heating unit is cooled by the blowing unit when the heating unit is operated.

12. The apparatus as set forth in claim 6, wherein the output of the gas sensor is a voltage level that is inversely proportional to the moisture inside the cooking cavity.

13. The apparatus as set forth in claim 6, wherein the control unit reduces the output of the heating unit to the second reduced output after a first preset time has elapsed and the output of the heating unit has been reduced to the first reduced output.

14. The apparatus as set forth in claim 13, wherein the first preset time varies with an amount of the millet.

15. The apparatus as set forth in claim 6, wherein the control unit terminates cooking of the millet after a second preset time has elapsed and the output of the heating unit has been reduced to the second reduced output.

16. The apparatus as set forth in claim 15, wherein a total cooking time is previously set according to an amount of the millet, and an end time point of the second preset time is limited to an end time point of the total cooking time.

17. A method of automatic cooking using a cooking apparatus, the cooking apparatus having a cooking cavity that contains food to be cooked and water therein, and a heating unit that heats the food and the water, comprising:

heating the food and the water at a preset initial output of the heating unit;

reducing the output of the heating unit to a first reduced output and cooking a surface of the food by allowing a heated temperature water to be absorbed into the food after the water has boiled; and reducing the output of the heating unit to a second reduced output and cooking an inside of the food using the heated temperature water absorbed into the food.

18. The method as set forth in claim 17, wherein the food includes millet.

19. The method as set forth in claim 17, wherein the first reduced output of the heating unit is 50~60% of the initial output, and the second reduced output of the heating unit is 45~55% of the first reduced output.

20. The method as set forth in claim 17, wherein the heating unit is a high frequency generation unit, an initial output of the high frequency generation unit is 800 W, the first reduced output of the high frequency generation unit is from 400~500 W and the second reduced output of the high frequency generation unit is 200 W.

21. The method as set forth in claim 20, wherein the first reduced output is 400 W if the food corresponds to a quantity for one or two persons, and the second reduced output is 500 W if the food corresponds to a quantity for three or four persons.

22. A method for automatic cooking using a cooking apparatus, the cooking apparatus having a cooking cavity that contains food to be cooked and water therein, a heating unit that heats the food and the water, and a gas sensor that detects properties of air inside the cooking cavity, comprising:

obtaining an output of the gas sensor while the food and the water are heated at a preset initial output of the heating unit;

reducing the output of the heating unit to a first reduced output and cooking a surface of the food by allowing a heated temperature water to be absorbed into the food if the output of the gas sensor reaches a preset value; and reducing the output of the heating unit to a second reduced output and cooking an inside of the food using the heated temperature water absorbed into the food.

23. The method as set forth in claim 22, wherein an initial output of the gas sensor is obtained before the food and the water is heated, a current output of the gas sensor is obtained when the food and the water are heated, and the output of the heating it is reduced to the first reduced output if a ratio of the current output of the gas senor to the initial output of the gas sensor reaches a preset value.

24. The method as set forth in claim 23, wherein the output of the heating unit is reduced to the first reduced output if the current output of the gas sensor is equal to or less than 60% of the initial output of the gas sensor.

25. The method as set forth in claim 22, further including minimizing moisture inside the cooking cavity by circulating the air inside the cooking cavity to obtain the initial output of the gas sensor.

26. The method as set forth in claim 25, further including using a blowing unit to circulate the air inside the cooking cavity, and to cool the heating unit when the heating unit is operated.

27. The method as set forth in claim 22, wherein the output of the gas sensor is a voltage level that is inversely proportional to the moisture inside the cooking cavity.

28. The method as set forth in claim 22, further including utilizing the first reduced output of the heating unit for a first preset time and then reducing the output of the heating unit to the second reduced output.

29. The method as set forth in claim 28, wherein the first preset time varies with an amount of the millet.

30. The method as set forth in claim 22, further including terminating cooking of the millet after a second preset time has elapsed and reducing the output of the heating unit to the second reduced output.

31. The method as set forth in claim 30, further including previously setting a total cooking time according to an amount of the millet, and limiting an end time point of the second preset time to an end time point of the total cooking time.

32. A method of automatic cooking using a cooking apparatus, the cooking apparatus having a cooking cavity that contains a predetermined amount of food to be cooked and water therein, and a heating unit that heats the predetermined amount of the food and the water, comprising:

blowing air into the cooking cavity for a first time period to minimize moisture therein; and heating the predetermined amount of food and water for predetermined times using an initial heating unit output and a series of decreasing heating unit outputs in accordance with the predetermined amount of food.

33. The method as set forth in claim 32, the heating comprising:

heating the predetermined amount of food and the water at the initial heating unit output to boil for a second time period;

heating the predetermined amount of food and the water at the second decreased heating unit output to simmer for a third time period; and heating the predetermined amount of food and the water at the third decreased heating unit output to steam for a fourth time period.

34. The method as set forth in claim 32, wherein the food includes millet.

35. The method as set forth in claim 33, wherein the heating unit is a high frequency generation unit, the initial heating unit output of the high frequency generation unit is 800 W, the second decreased heating unit output of the high frequency generation unit is from 400~500 W, and the third decreased heating unit output of the high frequency generation unit is 200 W.

36. The method as set forth in claim 20, wherein, where the predetermined amount of food is a first quantity for one or two persons, the second heating unit output is 400 W, and, where the predetermined amount of found is a second quantity for three or four persons, the second heating unit output is 500 W.

37. An apparatus for automatic cooking, comprising:

a cooking cavity that contains a predetermined amount of food to be cooked and water therein;

a heating unit that heats the predetermined amount of food and the water;

a gas sensor detecting properties of air in the cooking cavity; and a control unit, coupled to the heating unit and the gas sensor, controlling:

blowing air into the cooking cavity for a first time period to minimize moisture therein; and heating the predetermined amount of food and water for predetermined times using a series of decreasing heating unit outputs in accordance with the predetermined amount of food.

38. The apparatus as set forth in claim 37, the heating comprising:

heating the predetermined amount of food and the water at an initial heating unit output to boil for a second time period;

heating the predetermined amount of food and the water at a second decreasing heating unit output to simmer for a third time period; and heating the predetermined amount of food and the water at a third decreasing heating unit output to steam for a fourth time period.

39. The apparatus as set forth in claim 37, wherein the food includes millet.

40. The apparatus as set forth in claim 38, wherein the heating unit is a high frequency generation unit, the initial heating unit output of the high frequency generation unit is 800 W, the second decreasing heating unit output of the high frequency generation unit is from 400~500 W, and the third decreasing heating unit output of the high frequency generation unit is 200 W.

41. The apparatus as set forth in claim 37, wherein, where the predetermined amount of food is a first quantity for one or two persons, the second decreasing heating unit output is 400 W, and, where the predetermined amount of food is a second quantity for three or four persons, the second decreasing heating unit output is 500 W.

* * * * *

UNITED STATES PATENT AND TRADEMARK OFFICE

CERTIFICATE OF CORRECTION

PATENT NO. : 6,867,403 B2
DATED : March 15, 2005
INVENTOR(S) : Jong-Chull Shon et al.

It is certified that error appears in the above-identified patent and that said Letters Patent is hereby corrected as shown below:

Column 7,
Line 30, change “senor” insert -- sensor --;

Column 8,
Line 48, change “it” to -- unit --;
Line 49, change “senor” insert -- sensor --;

Column 10,
Line 1, change “found” insert -- food --.

Signed and Sealed this

Twenty-seventh Day of December, 2005

JON W. DUDAS
*Director of the United States Patent and Trademark Office*